United States Patent [19]

Skillicorn

[11] Patent Number: 4,694,480

[45] Date of Patent: Sep. 15, 1987

[54] HAND HELD PRECISION X-RAY SOURCE

[75] Inventor: Brian Skillicorn, Sunnyvale, Calif.

[73] Assignee: Kevex Corporation, Foster City, Calif.

[21] Appl. No.: 760,684

[22] Filed: Jul. 30, 1985

[51] Int. Cl.[4] ..... H05G 1/06

[52] U.S. Cl. ..... 378/119; 378/102; 378/110; 378/112; 378/141

[58] Field of Search ..... 378/102–104, 378/110, 112, 119, 141

[56] References Cited

U.S. PATENT DOCUMENTS

| | | | |
|---|---|---|---|
| 1,394,145 | 10/1921 | Coolidge | 378/141 |
| 1,974,328 | 9/1934 | Bouwers | 378/103 |
| 3,878,394 | 4/1975 | Golden | 378/102 |
| 4,418,421 | 11/1983 | Kitadate et al. | 378/102 |
| 4,439,868 | 3/1984 | Makino et al. | 378/112 |
| 4,517,472 | 5/1985 | Ruitberg et al. | 378/112 |
| 4,553,255 | 11/1985 | Kanerva | 378/112 |

FOREIGN PATENT DOCUMENTS

| | | | |
|---|---|---|---|
| 1066256 | 4/1967 | United Kingdom | 378/141 |

OTHER PUBLICATIONS

Kevex advertisement—"PXS TM —Portable X-Ray Sources" printed May, 1984.

*Primary Examiner*—Craig E. Church
*Assistant Examiner*—John C. Freeman
*Attorney, Agent, or Firm*—David B. Harrison

[57] ABSTRACT

A hand held x-ray source includes an x-ray tube and integral generator for exciting the tube at precisely controllable high voltage and direct current levels. The integral generator includes an elongated housing grippable by the hand and an elongated unitary molded block mounted in the housing and thermally sumped thereto. The block defines a first heat conduction fluid fillable cavity for receiving the tube and for providing a high voltage connection to the anode adjacent to the interior end thereof, the block being formed to contain and insulate interconnected elements providing a single voltage multipliers tack, and primary and secondary windings of a single high voltage switching transformer having a ferrite magnetic core external to the block. A heat conduction fluid is disposed between the tube and the block for conducting heat generated during tube operation to the block. An electronic circuit substrate in the housing carries circuit elements connected to the transformer and to the grounded filament for generating a precisely controllable exciting direct current high voltage applicable to the target of the tube and for generating a precisely controllable filament current through the filament of the tube.

19 Claims, 12 Drawing Figures

HAND HELD PRECISION X-RAY SOURCE

BACKGROUND OF THE INVENTION

The present invention relates to equipment for generating x-ray energy. More particularly, the present invention relates to a miniaturized modular x-ray source with integral generator for generating x-ray photons with precisely controlled and regulated energy and intensity levels.

REFERENCE TO RELATED PATENT

The reader is referred to the present inventor's copending U.S. patent application Ser. No. 519,402 filed on Aug. 1, 1983, for "Modular Portable X-ray Source with Integral Generator", now U.S. Pat. No. 4,646,338, the disclosure of which is incorporated herein by reference.

The modular source described in the above-referenced patent application worked very well in analytical and imaging applications requiring x-ray power levels at the fifty watt level. Such power levels typically require that the target of the x-ray tube which emits the useful x-ray energy in response to electron beam bombardment be grounded so that the intense heat generated at the target by the bombardment may be safely conducted away and dissipated. Grounded anode x-ray tubes have the drawback that the filament circuitry must be arranged at a high negative voltage level, thereby requiring considerable attention to the design of suitable insulation and isolation. Such requirements directly increase the amount (and weight) of insulating material and the complexity of the filament drive circuitry and transformer.

Many applications, while requiring useful power levels, do not require power levels in the fifty watt range, and five watts to 7 watts may satisfy these needs. While x-ray sources using grounded filaments are known in the prior art, a hitherto unsolved need has arisen for a simple, lightweight hand held precision x-ray source capable of generating x-ray photons at precisely controlled and regulated energy (kV) and intensity (I) levels.

SUMMARY OF THE INVENTION WITH OBJECTS

A general object of the present invention is to provide a hand held x-ray source which includes an integral generator (high voltage power supply) and which is capable of generating x-rays at precisely controlled and regulated energy and intensity levels which overcomes the limitations and drawbacks of prior art approaches.

A specific object of the present invention is to package an x-ray source with a shielded internal generator in a small elongated housing about the size of a large flashlight thereby enabling it to be held in one hand of an operator during use.

Another object of the present invention is to provide an elongated molded block which houses the x-ray tube and which conducts the heat generated by the tube during use to the housing for dissipation into the ambient environment.

A further object of the present invention is to provide an elongated block for an x-ray source with integral generator which encapsulates the windings of a high voltage transformer and the capacitors and diodes of a high voltage multiplier in a geometry which provides the requisite insulation while minimizing the amount of encapsulating material, thereby minimizing the mass of the block and reducing the weight of the source. An hourglass crossectional outline is one preferred form for the molded block wherein voltage multiplying capacitors are embedded in the outside cylindrical regions of the block and voltage multiplying diodes are embedded in a central narrowed region connecting the cylindrical regions.

One more object of the present invention is to minimize the amount and volume of electronic circuitry required to generate excitation signals for a hand held x-ray source with integral generator, so that the electronics may be included in the hand held package without unduly increasing its size or weight and while providing a very high level of control and regulation to the source.

A still further object of the present invention is to provide a small, hand held modular x-ray source which may be operated directly from a small storage battery (or dry cells).

One more object of the present invention is to provide a hand held x-ray source with integral generator which is simplified in construction, which has been minimized in weight without compromising safety of the operator or quality of the x-rays generated, and which may be manufactured economically and used reliably over a useful life extended by inclusion of protection circuitry to minimize filament burnout and excessive power dissipation within the tube.

These objects are achieved in a hand held x-ray source including an x-ray tube and an integral generator for exciting the tube at precisely controllable energy and intensity levels. The tube includes an elongated cylindrical insulating envelope, an elongated anode support structure extending axially in the envelope from an interior high voltage connection end to adjacent an exterior end of the tube and supporting an electron beam target. A thermionic emission filament for operation at ground potential is formed and located in the tube at the exterior end thereof, and it creates an electron beam directed at the target. The tube also includes an x-ray window at its exterior end.

The integral generator includes an elongated housing grippable by the hand; an elongated unitary molded block mounted in the housing and thermally sumped thereto, the block defining a first heat conduction fluid fillable cavity for receiving the tube and for providing a high voltage connection to the anode adjacent to the interior end thereof, the block being formed to contain and insulate interconnected elements providing a single voltage multiplier stack, and primary and secondary windings of a single high voltage switching transformer having a ferrite magnetic core external to the block. A heat conduction fluid is disposed between the tube and the block for conducting heat generated during tube operation to the block and thence to the housing for dissipation into the ambient environment.

An electronic circuit substrate is mounted in the housing and it carries circuit elements connected to the single transformer and to the grounded filament to enable generation of a precisely controllable, exciting direct current high voltage applicable to said target and a precisely controllable filament current through said filament.

In one aspect the molded block defines a second fluid expansion reservoir cavity formed adjacent to the first cavity, the second cavity being connected to the first cavity by a fluid passage through the block and being partially filled with the heat conduction fluid, and a flexible membrane covers the cavity in order to prevent escape of fluid as it expands upon heating by the x-ray tube.

In another aspect the second cavity is covered by a cover which seals the membrane to the housing and to the block. The membrane cover includes an air vent passage therethrough to permit the membrane to displace ambient air in the space between the cover and the membrane within the cavity.

In a further aspect of the present invention the x-ray tube window includes a shield-collimator for limiting x-ray emission from the tube to a predefined narrow cone of radiation, such as 20° divergence.

In yet another aspect of the present invention heat dissipation fins are thermally sumped to and extend from the housing for dissipation of heat generated by the tube during operation.

In one more aspect of the present invention the molded block is surrounded by a lead sheath for shielding the operator against unwanted x-ray energy emissions.

In a still further aspect of the present invention, the block defines in transverse cross-section an hour-glass shape so as to optimize distribution of the voltage multiplier elements and optimize insulative properties of the molding material while minimizing the mass of which the block is formed.

Other aspects of the present invention include a thermally insensitive voltage regulator for generating a voltage reference which is invariant during wide excursions of temperature within the housing; a first pulse width modulator for generating a x-ray energy driving signal used to generate the high voltage; a second pulse width modulator for generating an x-ray intensity driving signal used to excite the grounded filament of the x-ray tube; high voltage sensing circuitry for sensing directly the high voltage applied to the target of the tube and comparison circuitry for comparing a sense signal derived by said voltage sensing means with a variable high voltage control reference signal to generate an error signal which is applied to operate the first pulse width modulator, the variation of the reference signal thereby controlling the high voltage applied to the anode of the tube; beam current sensing circuitry comprising a connection to a centertap of a secondary winding of a filament transformer for sensing directly the beam current passing from the filament to the target of the tube and comparison circuitry for comparing a beam current sense signal derived from the beam current sensing means with a variable beam control reference signal to generate an error signal which is applied to operate the second pulse width modulator, the variation of the beam control reference signal thereby controlling the beam current passing through the tube and the resultant intensity of the x-rays produced therein.

As a further aspect of the present invention protection circuitry is included to protect and extend the life of the x-ray tube, including beam current limit circuitry for limiting beam current to a maximum presettable current value, filament current limiting circuitry for sensing the current passing through the filament and for controlling the second pulse width modulator in order to limit sensed current to a maximum predetermined value.

These objects, advantages, aspects and features of the present invention will be more readily apparent and more easily understood by considering the following detailed description of a preferred embodiment, presented in conjunction with the accompanying drawings.

DETAILED DESCRIPTION OF A PREFERRED EMBODIMENT

Figure 1:
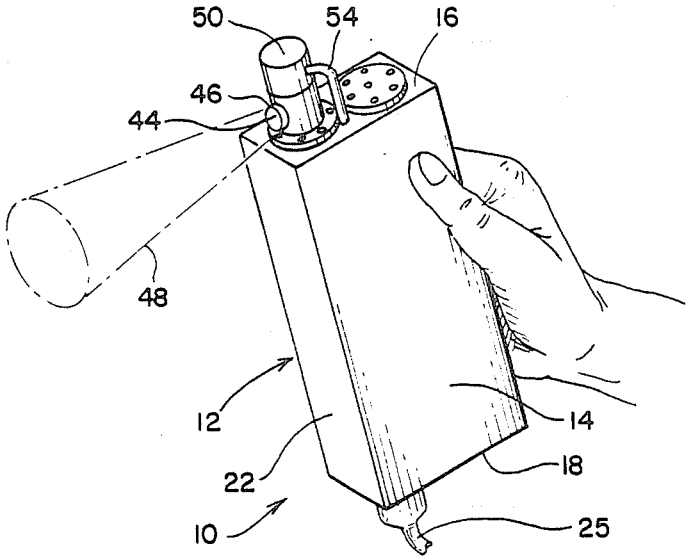
FIG. 1 is a diagrammatic view in perspective of a hand held x-ray source with integral generator incorporating the principles of the present invention showing it being held in the operator's hand and operated.

A hand held x-ray source 10 includes an elongated, rectangular housing 12 comprising a top 14, a front 16, a rear 18 a bottom 20, and two sides 22 and 24. A power cable 25 plugs into a socket 27 in the rear wall 18, and facilitates connection of the unit 10 to a small storage battery or other low voltage source, such as 12 volts at 2 amperes. The cable 25 also carries wires enabling remote control and monitoring of the unit 10 as will be more completely explained in connection with FIG. 8. The housing 12 includes all of the elements which are required for the highly portable source. In practice the assembled source 10 weighs approximately three pounds and provides x-rays excited from a DC high voltage supply controllable in the range of from 4 through 70 kV at beam current levels up to 100 micoramperes at 70kV. A warning label 29 on the top wall 14 is provided to remind the operator of the hazards related to operation of the x-ray source 10.

X-RAY TUBE 26

An x-ray tube 26 includes a filament 28 intended to be operated at ground potential with respect to the anode or target 30 thereof. The tube 26 includes an elongated cylindrical glass envelope 32 in which a central anode support structure 34 extends longitudinally from an inner end connection location 36 to the target 30. The support structure may be made of copper and its length aids in drawing heat away from the target and dissipating it as radiant energy to the glass envelope.

Figure 2:
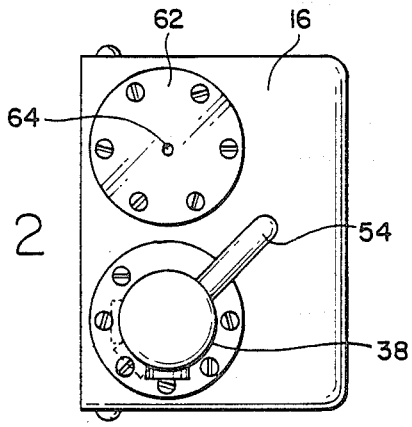
FIG. 2 is a front (tube) end plan view of the source of FIG. 1.
Figure 3:
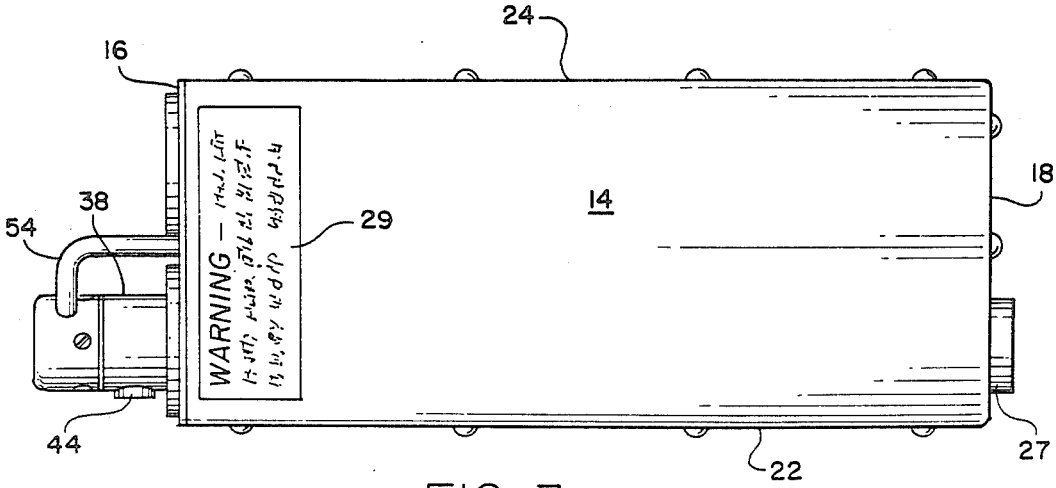
FIG. 3 is a top plan view of the FIG. 1 source.
Figure 4:
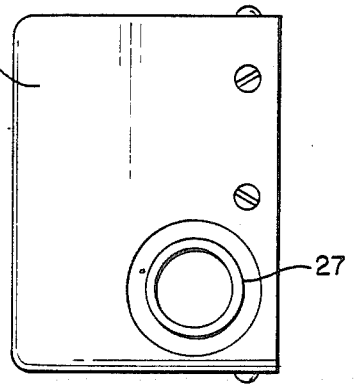
FIG. 4 is a rear (cable) end plan view of the FIG. 1 source.
Figure 5:
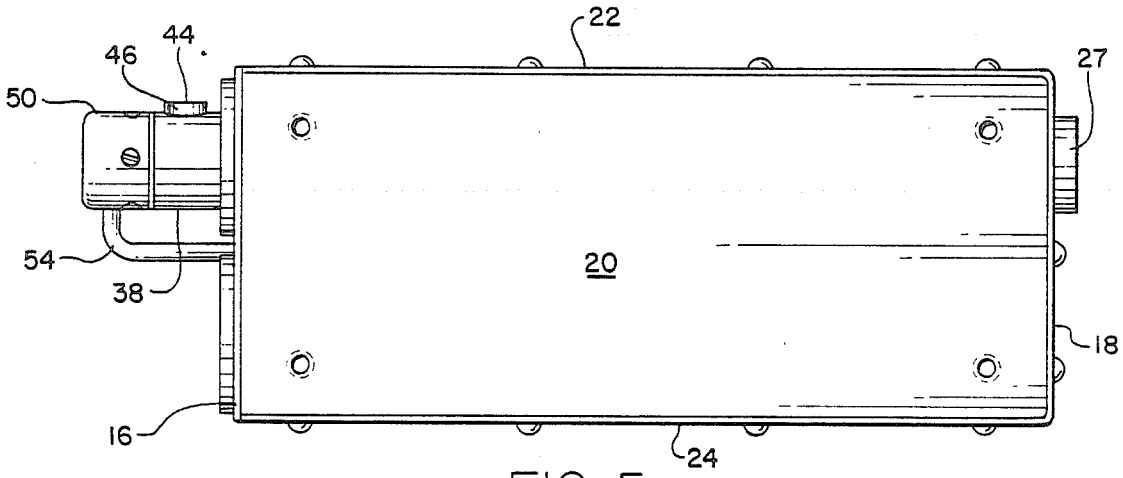
FIG. 5 is a bottom plan view of the FIG. 1 source.

A flanged metal cap 38 enables the tube 26 to be mounted through the front end 16 of the housing and seated in a first cavity 40 of a molded block 42. The tube 26 includes a window 44 of suitable x-ray translucent material, such as beryllium. The window 44 may also include an annular shield-collimator 46 which is provided to constrict the x-rays leaving the window to a narrow cone 48 of e.g. twenty degrees (20°), as diagrammed in FIG. 1. A cap 50 fits over the tube and it covers a connection between connecting pins 52 for the filament 28 and filament wires leading into the housing 12 which are contained in a small diameter curved metal pipe section 54 which protects the wires. The broken lines in FIG. 2, and the alternative window arrangement shown in FIGS. 6 and 7 suggest the wide variety of geometries and arrangements which are available for the x-ray tube window 44. The window may also be disposed in the top end of the tube 26, in which case, the cap 50 would be eliminated.

MOLDED BLOCK 42

The block 42 is molded of material which is high in both thermal conduction and electrical insulation properties. A curable resin is vacuum formed to encapsulate the elements depicted in FIG. 6 in order to provide the block 42.

A second, much shallower cooling oil reservior cavity 56 is formed in the block 42. A passage 58 connects the cavity 56 to the tube cavity 40, and this passage 58 enables cooling oil to expand into the cavity 56 as the heat generated by the tube 26 causes the oil to expand. A flexible, oil impermeable membrane 60 closes the cavity 56, thereby preventing the cooling oil from escaping. A disk cover 62 mounted to the front end wall 16 e.g. by screws (FIG. 2) defines a small air vent 64 which enables the air behind the membrane 60 to escape as it flexibly permits the oil to expand and fill the reservoir cavity 56. The cover 62 seals the membrane in place, and prevents escape of cooling oil.

Figure 6:
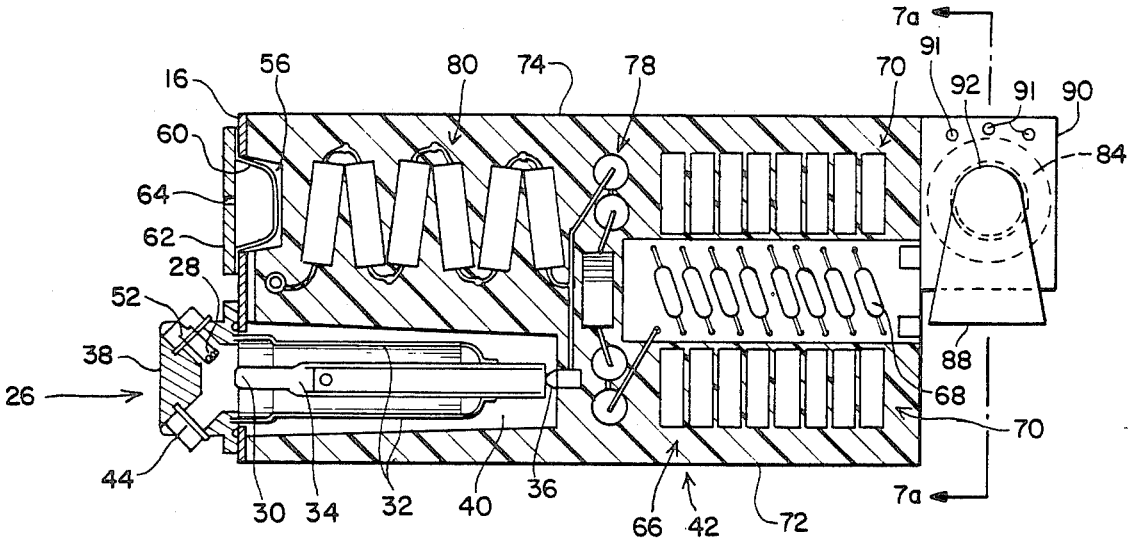
FIG. 6 is a diagrammatic plan view of a section of the molded block, illustrating one preferred form of layout of components comprising the x-ray tube, voltage multiplier, expansion baffle and high voltage transformer windings with external ferrite core. In this view, the tube has a slightly different filament and window configuration, thereby illustrating the many suitable variations available for tube geometry.
Figure 7:
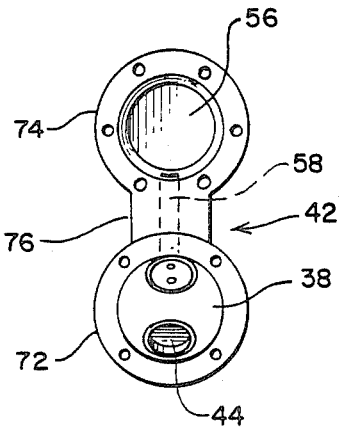
FIG. 7 is a front end plan view of the molded block depicted in FIG. 6.

A Cockcroft-Walton type of voltage multiplier 66 is molded into the block 42 as shown in FIG. 6. Multipliers of this type include series-connected stages of diodes and capacitors. The diodes 68 are very small while the capacitors 70 are much larger. It has been found that if the block 42 is molded in the form having an hourglass cross-sectional outline such as shown in FIG. 7, the capacitors 70 may be molded into two cylindrical regions 72, 74 of the block, while the diodes 68 may be molded into a narrowed central region 76 interconnecting the cylindrical regions 72, 74. The position of one capacitor 70 is shown generally by the broken line outline inside the region 72 in FIG. 7A.

An eight stage, single ended multiplier 66 is shown in FIG. 6. This multiplier is suitable for generating high voltages up to about 50 kV. A ten stage multiplier, operating from a base voltage of 5 kV will multiply up to about 70 kV at 100 microamperes. A stack of series resistors 78 provides for current limiting in the event of arc over of the high voltage applied to the target 30, while a second resistance stack 80 drops the voltage on the target (e.g. 50 kV) to a low sense voltage (e.g. 2.5 volts) directly proportional to the sensed high voltage. These resistor stacks 78, 80 are molded in the block 42 behind the second reservoir cavity 56 in the cylindrical region 74.

Figure 7A:
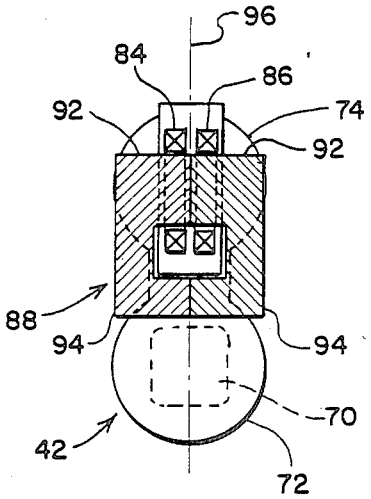
FIG. 7A is a sectional view in elevation of the molded block along the line 7A—7A in FIG. 6.
Figure 8:
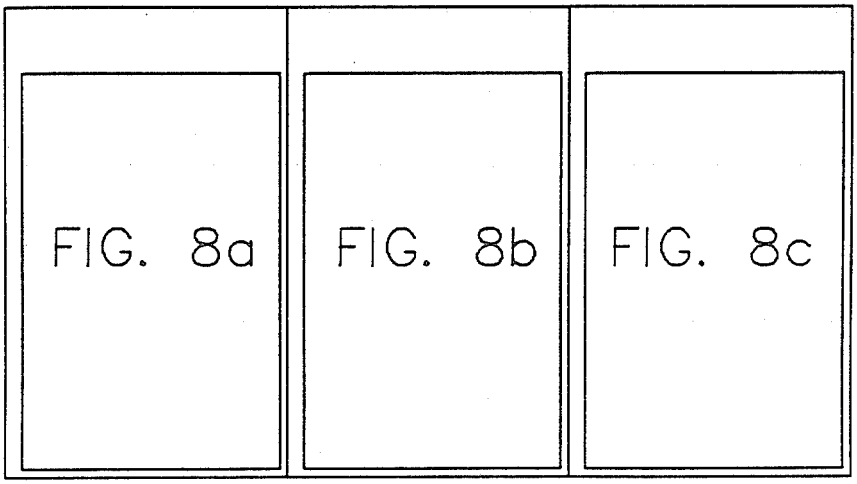
FIG. 8 is a layout plan showing an arrangement by which FIGS. 8*a*, 8*b* and 8*c* should be read.
Figure 8A:
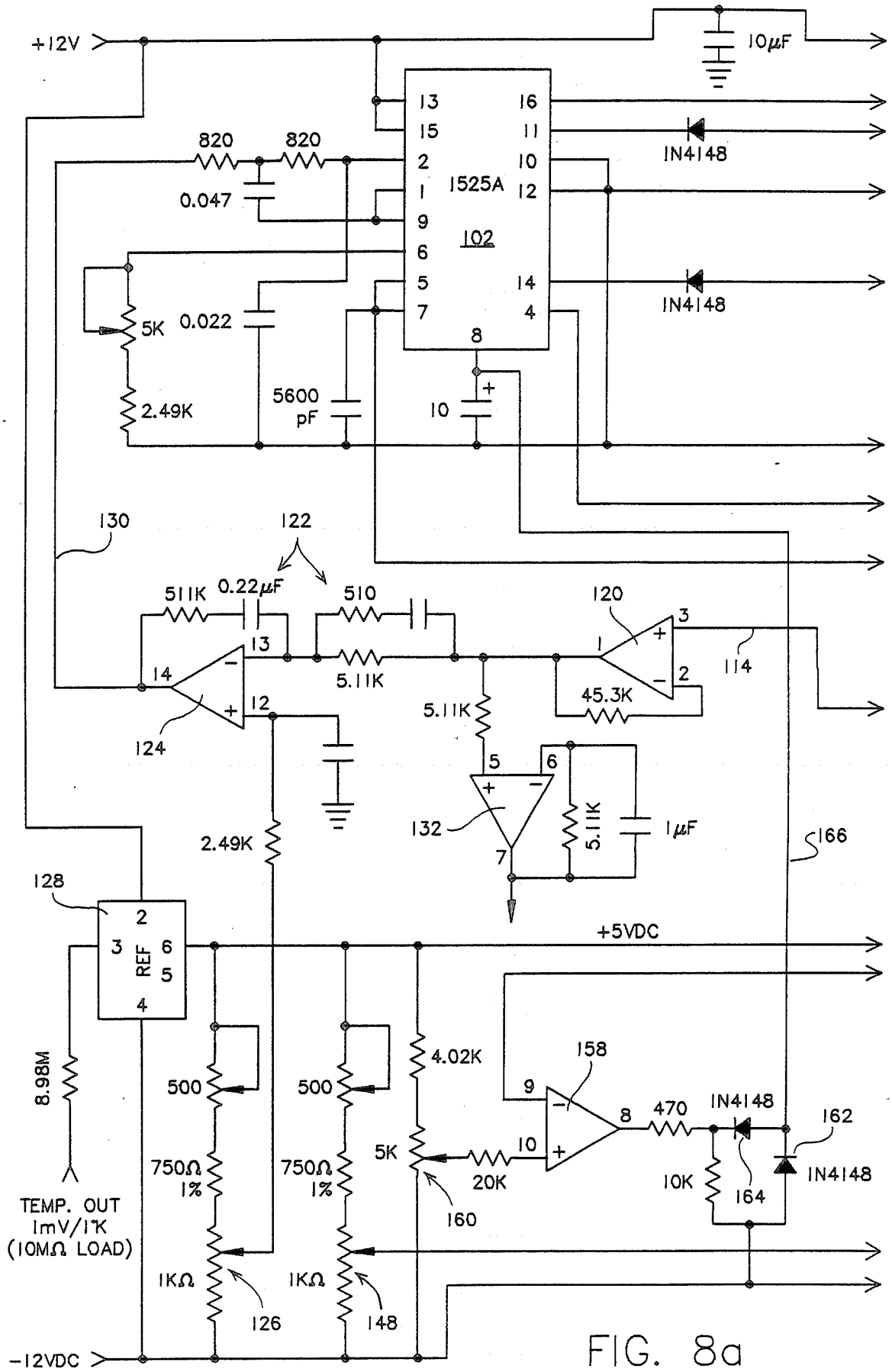
FIGS. 8*a*, 8*b*, and 8*c* together provide an electrical schematic and circuit diagram of the circuitry included in the source of FIG. 1, for operation directly from a twelve volt battery.
Figure 8B:
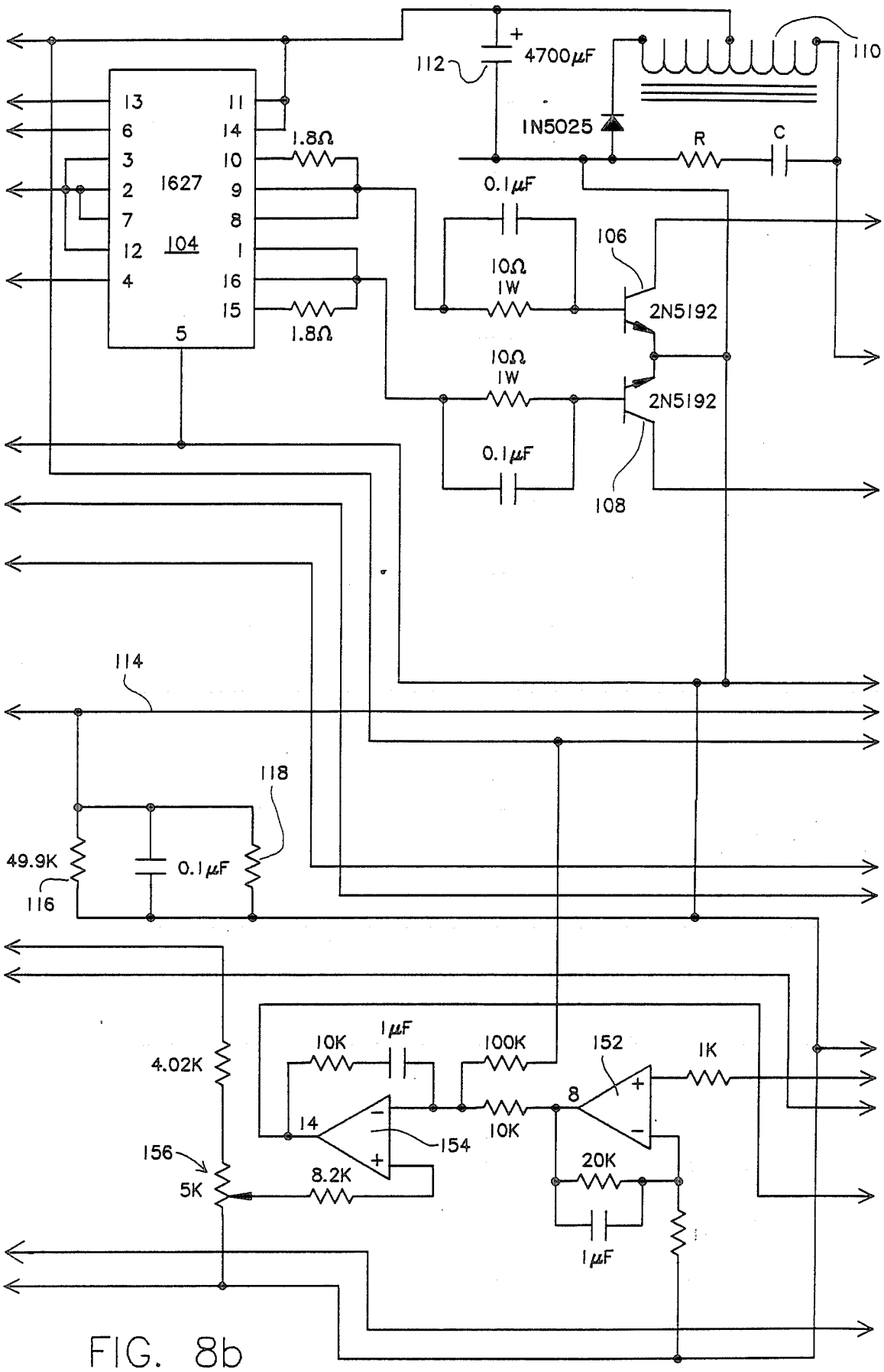
Figure 8C:
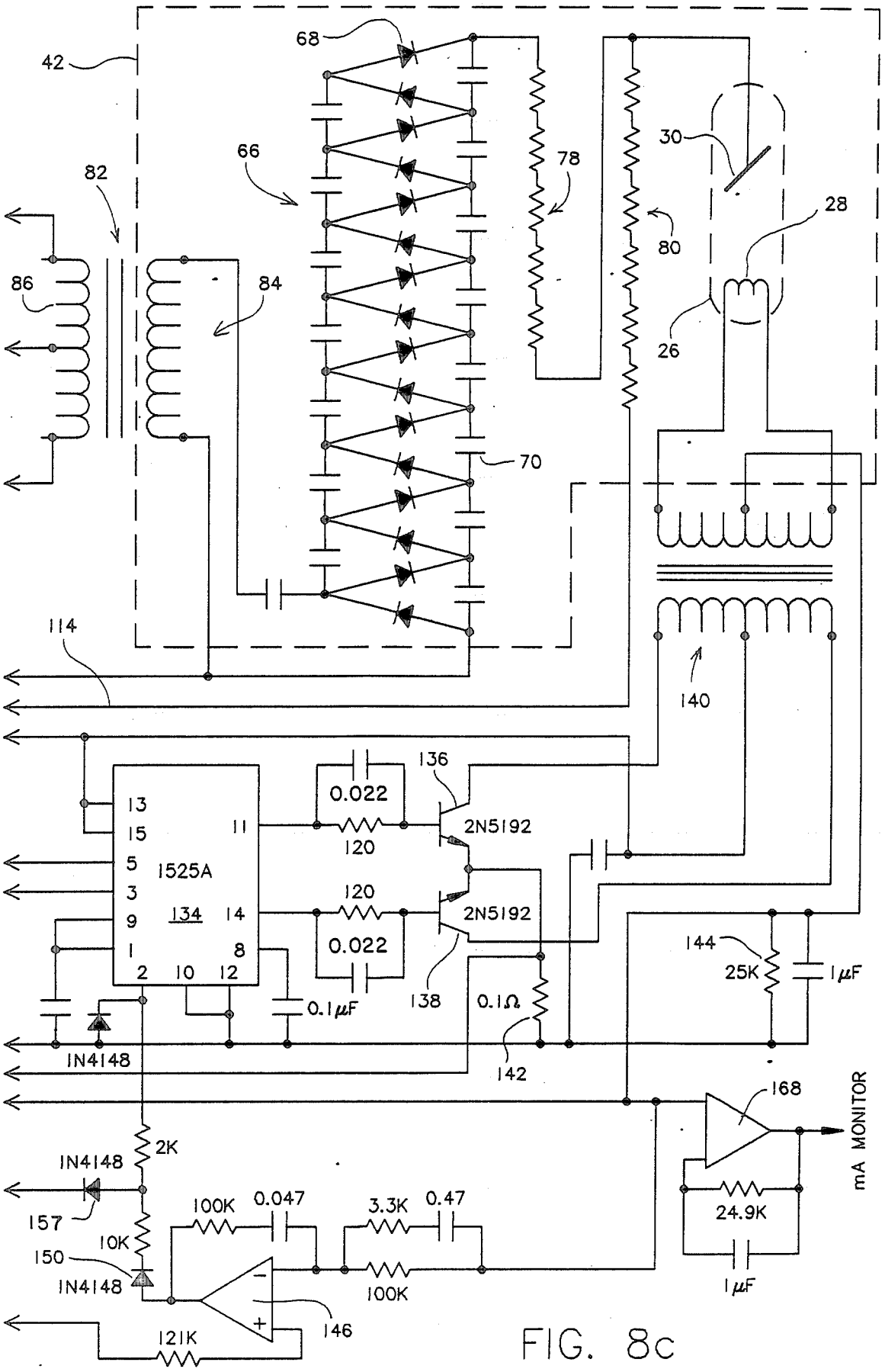

A single high voltage transformer 82 includes a centertapped primary winding 84, a secondary winding 86 and a two piece ferrite core 88 as shown in FIGS. 6, 7A and 8. The windings 84 and 86 are integrally molded and connected within an extension 90 of the block 42. Three terminals 91 are molded in the block to enable electrical connection to the primary windings 86. The two piece ferrite core 88 is external to the block and includes aligned cylindrical portions 92 which enter a cylindrical opening through the windings 84, 86, and flattened U-shaped portions 94 which are positioned to surround the cylindrical portions 92 and thereby enclose the magnetic flux loop. This arrangement of the ferrite core 88 places the flattened portions out of the way and thereby enables a very compact overall package for the unit 10. The two portions of the core 88 abut each other along a shear plane 96 as shown in FIG. 7A.

In use, the block 42 is surrounded by a closely fitting lead sheath which shields the operator from any x-rays that may be produced in the block during arc-over or x-ray leakage from the tube 26.

ELECTRICAL CIRCUITRY

The electrical circuit elements of the source unit 10 are depicted in the electrical schematic of FIG. 8. Therein, a pulse width modulator 102 generates a driving signal at approximately 20 kHz with a controlled duty cycle. The two phase outputs signals from the PWM 102 are supplied to a monolithic driver circuit 104 where they are amplified and are applied to the bases of two switching output transistors 106, 108. The collectors of the transistors 106, 108 are connected to the primary winding 86 of the power transformer 82. The center tap thereof is connected to a centertapped flyback inductor 110 which dumps current into a storage capacitor 112 during a flyback phase of operation of the high voltage transformer 82 so as to sustain power oscillation as is conventional with switching power supplies. The center tap of the inductor 110, and the capacitor 112 are connected to the plus 12 volt bus, and the switching return path is through the primary 86 and the transistors 106 and 108 to the ground bus.

The high voltage sensed through the resistor stack 80 is passed on a high voltage sense line 114 and through a resistor 116. The low voltage which is analogous directly to the high voltage is developed across the resistor 116. A shunt resistor 118 is provided in order to enable precise calibration of the high voltage feedback sensing circuit, now to be described.

An operational amplifier 120 acts as a unity gain buffer, and delivers the sensed signal through a phase compensation network 122 to an inverting input of a differential amplifier 124. The amplifier 124 has a non-inverting input connected to a voltage set potentiometer 126 which is connected to a source 128 of a precise reference voltage, e.g. 5 volts, which is immune to variations with temperature. The setting of the potentiometer 126 determines the reference voltage applied to the differential amplifier 124, and the difference between sensed voltage and reference voltage results in a high voltage error signal on an output line 130 which is used to modulate the width of the pulses generated by the PWM 102, thereby controlling the high voltage.

A buffer amplifier 132 is provided to enable remote monitoring of sensed high voltage.

A second pulse width modulator 134, also operating at 20 kHz in synchronism with the PWM 102, generates a driving voltage for the filament 28. The voltage put out by PWM 134 drives two push-pull transistors 136, 138, the collectors of which are connected to a primary of a filament transformer 140. A center tap for the primary is connected to the plus 12 volt bus, and the switching signal return path is through the filament transformer primary, the transistors 136, 138 and a common emitter resistor 142 to ground.

X-ray tube beam current is sensed at a centertap of the secondary of the filament transformer. This current is developed into a voltage across a resistor 144 and applied to an inverting input of a differential amplifier 146. A reference voltage is provided by the setting of a beam current adjust potentiometer 148 which is connected to the precision reference voltage source 128. Any difference between the beam current sense voltage across resistor 144 and the voltage set by the potentiometer 148 will result in an error voltage which is applied to the filament PWM 134 through a diode 150.

A filament burn out protection circuit is provided for the unit 10. A voltage analogous to filament current is developed across the common emitter resistor 142. This voltage is buffered through an amplifier 152 and is then applied to an inverting input of a differential amplifier 154. A reference voltage analogous to maximum permissible filament current is set by a potentiometer 156 which is connected to the precision voltage reference 128. This reference voltage is compared with the filament current sense voltage developed across the resistor 142, and any error voltage put out by the amplifier 154, which is in excess of the voltage put out by the amplifier 146 causes a diode 157 to conduct and the diode 150 to open. This enables the amplifier 154 to take over control of the filament PWM 134 and thereby reduce and maintain filament current at the maximum safe value.

A beam current protection circuit senses the voltage developed across the resistor 144. This circuit includes a differential amplifier 158 having its inverting input connected to the resistor 144 (and to the centertap of the secondary of the filament transformer 140). Its reference input is connected to a potentiometer 160 which is set to a reference voltage corresponding to maximum permissable beam current through the x-ray tube 26. If the error voltage put out by the amplifier 158 exceeds a voltage developed across a diode 162, the diode 162 opens, and a second diode 164 conducts, thereby enabling the amplifier 158 to shut down the high voltage PWM via a connection line 166.

A buffer amplifier 168 enables external circuitry to monitor beam current.

HEAT FINS 170

Figure 10:
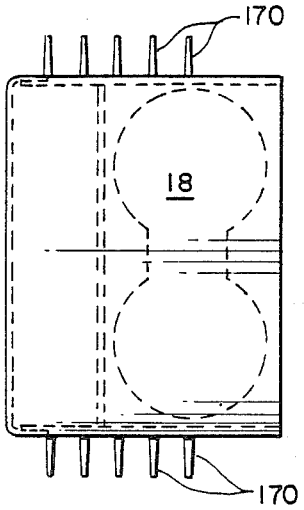
FIG. 10 is a rear end plan view of the housing of FIG. 9, showing the heat dissipating fins.
Figure 9:
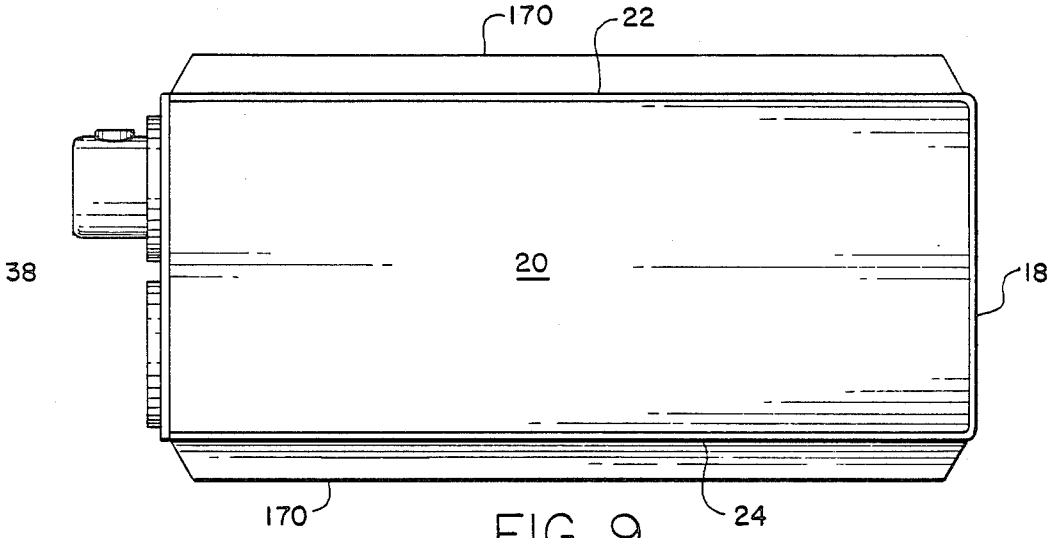
FIG. 9 is a top plan view of a housing for the FIG. 1 source which has been provided with external cooling fins to facilitate heat dissipation into the surrounding ambient environment.
Figure 11:
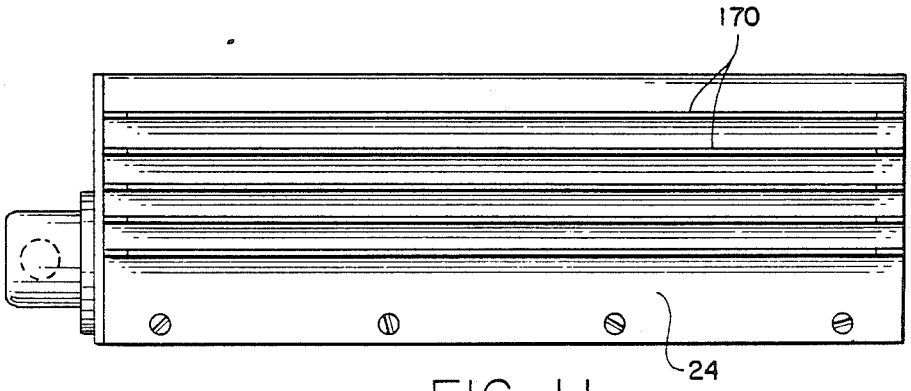
FIG. 11 is a side view in elevation of the housing of FIG. 9, also showing the fins on one side.

FIGS. 9–11 illustrate the provision of heat dissipation fins 170 on the housing 12. While heat fins may take many forms, considering the ultimate desired geometry of the unit 10, the fins have proven effective in dissipating heat in the units which operate at a maximum of 70 kV. Whether the fins 170 are provided or not, it is advantageous to bond the block 42 to the housing 12 to enhance thermal transfer. Potting compound having a high thermal conductivity is preferably used to cement the block into the housing 12 and to eliminate all air passages between the block and the housing.

While apparatus of the present invention has been summarized and explained by illustrative applications of a hand held portable x-ray source unit including an integral precision high voltage and beam current generator, it will be readily apparent to those skilled in the art that many widely varying embodiments and applications are within the teachings and scope of the present invention, and that the examples presented herein are by way of illustration only and should not be construed as limiting the scope of this invention.

I claim:

1. A hand held x-ray source including an x-ray tube and integral generator for exciting the tube at precisely controllable high voltage and direct current levels, the tube including an elongated cylindrical insulating envelope, an elongated electrically conductive anode support structure extending axially in said envelope from a high voltage connection end to an electron beam target adjacent a target end of the tube, a thermionic emission filament ground potential formed and located in said tube at the target end for creating an electron beam directed at said target, and an x-ray window at said target end, the integral generator including:

an elongated housing grippable by the hand, an elongated unitary molded block mounted in the housing and thermally sumped thereto, the block being generally oval in cross section and having two end walls, the block having three longitudinal regions aligned in tandem, a first region at one end of the block defining a first heat conduction fluid fillable longitudinally extending cavity having an exterior opening at one of the endwalls of the block, the cavity for receiving the tube and for providing a high voltage connection to the anode support structure at an interior end enclosed by the block adjacent to the high voltage connection of the tube, the block having a second region adjacent the first region for containing and encapsulating interconnected capacitor and diode elements providing a single voltage multiplier stack, and the block having a third region adjacent the second region containing and encapsulating primary and secondary windings of a single high voltage switching transformer means having a ferrite magnetic core for generating a high voltage and having internal connections of the secondary to the voltage multiplier stack and external primary leads, heat conduction fluid disposed between the tube and the block for conducting heat generated during tube operation to the block, an elongated electronic circuit substrate in the housing adjacent to a side of the block and carrying circuit elements connected to said primary of said single transformer and to said grounded filament for generating a precisely controllable, regulated exciting direct current high voltage applicable to said target and for generating a precisely controllable, regulated filament current through said filament.

2. The source set forth in claim 1 wherein said block defines a second fluid expansion reservoir cavity formed in said first region laterally adjacent to the first cavity, the second cavity being connected to the first cavity by a fluid passage through said block and being partially filled with heat conduction fluid, and a flexible membrane covering said cavity to prevent escape of fluid as it expands upon heating by said tube.

3. The source set forth in claim 2 wherein said cavity is covered by a cover which seals said membrane to said housing and to said block, said cover including an air vent passage therethrough to permit said membrane to displace ambient air in the space between the cover and the membrane within the cavity.

4. The source set forth in claim 1 wherein said window including shield-collimation means for limiting x-ray emission from the tube to a predefined cone.

5. The source set forth in claim 1 further comprising heat dissipation fins thermally sumped to and extending from said housing for dissipation of heat generated by the tube during operation.

6. The source set forth in claim 1 wherein said block is surrounded by sheath means for shielding the operator against unwanted x-ray energy emissions.

7. The source set forth in claim 1 wherein said block defines in transverse cross-section generally an hourglass shape for effectively encapsulating two spaced apart cylindrical ceramic capacitor arrays in thickened outer parts of the second region and a diode array connecting to the two capacitor arrays and located in a thinned longitudinally central portion of the second region so as to optimize distribution and insulative properties and minimize mass of the moulding material of which the block is formed.

8. The hand held x-ray source set forth in claim 1 wherein the transformer means of the block comprises a transverse cylindrical opening generally perpendicular to the major sides and extending through the center of said primary and secondary windings for receiving the ferrite magnetic core external to the block.

9. The source set forth in claim 1 wherein said first region of said block includes voltage sensing means for sensing directly the high voltage applied across the x-ray tube and wherein said electronics circuit substrate includes comparison circuitry for comparing a sense signal derived by said voltage sensing means with a variable high voltage control reference signal to generate an error signal which is applied to operate a high voltage drive pulse width modulator, the variation of the reference signal so as to regulate automatically the high voltage applied to the anode of the x-ray tube.

10. The source set forth in claim 1 wherein said electronics circuit substrate includes beam current sensing means comprising a connection to a centertap of a secondary winding of a filament transformer for sensing directly the electron beam current passing from the filament to the target of the x-ray tube and comparison means for comparing an electron beam current sense signal derived from the electron beam current sensing means with a variable electron beam control reference signal to generate an error signal which is applied to regulate operation of a filament driver pulse width modulator, the variation of the electron beam control reference signal thereby regulating the electron beam current passing through the x-ray tube and the resultant intensity of the x-rays produced therein.

11. The source set forth in claim 10 including electron beam current limit circuitry for limiting electron beam current to a maximum presettable value.

12. The source set forth in claim 10 wherein said circuit elements include filament current limiting means for sensing the current passing through the filament of the x-ray tube and for control providing override of the filament driver pulse width modulator in order to limit sensed filament current to a maximum predetermined value.

13. The source set forth in claim 1 for operation with a direct current battery source.

14. The source set forth in claim 13 wherein said direct current battery source supplies approximately 12 volts, and approximately two amperes of direct current.

15. The source set forth in claim 1 wherein said secondary winding develops a peak voltage of approximately 3.5 kilovolts and the voltage multiplier comprises five stages and multiplies this voltage into a range including thirty kilovolts direct current.

16. The source set forth in claim 1 wherein said secondary winding develops a peak voltage of approximately 3.5 kilovolts and the voltage multiplier comprises eight stages and multiplies this voltage into a range including fifty kilovolts direct current.

17. The source set forth in claim 1 wherein said secondary winding develops a peak voltage of approximately five kilovolts and the voltage multiplier comprises ten stages and multiplies this voltage into a range including seventy kilovolts direct current.

18. An elongated molded block including an x-ray source and integral generator, the block having a cross-sectional geometry which provides for two enlarged cylindrical portions aligned with the longitudinal axis of the block and joined by a thinned, flat central portion, the block having three longitudinal regions aligned in tandem, a first region at one end of the block defining a first heat conduction fluid fillable longitudinally extending cavity opening at a first end wall of the block for receiving an elongated x-ray tube and for providing a high voltage connection to an anode target connection of the x-ray tube adjacent to an interior end enclosed by the block the block having a second region adjacent the first region for encapsulating the capacitors and diodes of a single high voltage multiplier stack wherein voltage multiplying capacitors are embedded in the cylindrical portions of the second region of the block and voltage multiplying diodes are embedded in the thinned flat central portion lying between the cylindrical portions, and the block having a third region adjacent the second region containing and encapsulating primary and secondary windings of a single high voltage switching transformer means including a ferrite magnetic core for generating a high voltage and having internal connections of the secondary to the voltage multiplier stack and external primary leads.

19. The elongated molded block set forth in claim 18 wherein the third region defines a transverse cylindrical opening generally perpendicular to the major sides and extending through the center of said primary and secondary windings of the transformer means for receiving a ferrite magnetic core external to the block.

* * * * *